252-99. AU 165 EX
2-3-76 OR 3,936,386

United States Patent [19]
Corliss et al.

[11] 3,936,386
[45] Feb. 3, 1976

[54] DISHWASHING COMPOSITIONS CONTAINING CHLORINATED ISOCYANURATE

[75] Inventors: Duncan S. Corliss, Roselle; James F. Pacheco, Willingboro, both of N.J.

[73] Assignee: FMC Corporation, Philadelphia, Pa.

[22] Filed: Aug. 6, 1973

[21] Appl. No.: 385,843

[52] U.S. Cl. ..... 252/99; 23/313 AS; 252/187 R
[51] Int. Cl.[2] ..... C11D 7/56
[58] Field of Search ... 252/99, 187; 23/313, 313 AS

[56] References Cited

UNITED STATES PATENTS

| | | | |
|---|---|---|---|
| 3,352,785 | 11/1967 | Corliss et al. | 252/99 |
| 3,390,092 | 6/1968 | Keast et al. | 252/99 |
| 3,410,804 | 11/1968 | Walsh | 252/99 |
| 3,431,206 | 3/1969 | Hilton et al. | 252/99 |
| 3,491,028 | 1/1970 | Crotty et al. | 252/103 |
| 3,549,539 | 12/1970 | Mallows | 252/99 |
| 3,554,915 | 1/1971 | Keay et al. | 252/99 |
| 3,682,829 | 8/1972 | Cooper et al. | 252/99 |
| 3,701,735 | 10/1972 | Finck | 252/99 |

*Primary Examiner*—Mayer Weinblatt
*Assistant Examiner*—Bruce H. Hess

[57] ABSTRACT

An agglomerated dishwashing composition containing the following components:

| | |
|---|---|
| Sodium dichloroisocyanurate dihydrate | 0.5–10% |
| A polyphosphate having an $Na_2O$ or $K_2O$ to $P_2O_5$ ratio of about 1:1 to 2:1 | 25–60% (anhydrous basis) |
| Sodium carbonate | 0–60% (anhydrous basis) |
| A sodium silicate having a $SiO_2$ to $Na_2O$ ratio of from about 2.40 to about 3.22 | 10–15% (total silicate solids) |
| Low-foaming chlorine-compatible nonionic surfactant | 1–10% |
| Water | 5–20% |

The compositions exhibit lower chlorine loss than similar formulations containing commercial anhydrous sodium dichloroisocyanurate as the dry bleach component.

5 Claims, No Drawings

DISHWASHING COMPOSITIONS CONTAINING CHLORINATED ISOCYANURATE

This invention relates to detergent compositions, and in particular to automatic dishwashing detergent compositions containing a chlorinated isocyanurate.

Automatic dishwashing compositions are well known chemical entities which are familiar in the detergent art. Such compositions commonly contain a known detergent builder such as sodium tripolyphosphate with alkaline inorganic salts such as sodium silicate, sodium carbonate and/or other similar salts. A low-foaming, chlorine-compatible nonionic surfactant may also be included. For greater cleansing action, a chlorinated alkali metal isocyanurate is added as a destainer and germicide.

The compositions aforesaid are normally formulated by dry-blending or by agglomeration. In dry-blending, the pulverized components are merely mixed together, as by tumbling, to form the final product. In agglomeration, a specialized mixing technique is employed wherein the thoroughly commingled dry components are wetted in a controlled manner with the nonionic surfactant and the silicate in solution form while the mass is thoroughly stirred. The resulting product is a free-flowing granular product. It does not cake up during storage nor undergo segregation when handled or in use. Commercial automatic dishwashing compositions are usually of the agglomerated type.

A serious problem that is associated with automatic dishwashing compositions containing chlorinated isocyanurates is their rather limited chemical stability as manifested by the loss of available chlorine during formulation and storage.

In the case of dry blended products, the problem has been mitigated by resort to various expedients. For instance, in U.S. Pat. No. 3,166,513 to Mizuno et al., it is reported that the rate of chlorine loss is substantially reduced where the active chlorine component is potassium dichlorocyanurate. Another approach is the incorporation of chemical stabilizers such as a nonionic surfactant as proposed in U.S. Pat. No. 3,352,785 to Corliss et al. or the white paraffin oil additive of the U.S. Pat. No. 3,390,092 to Keast et al.

In the case of agglomerated automatic dishwashing compositions, the problem of chlorine loss is much more severe than with the dry mixes. So far as is known, an agglomerated product has not been realized containing a chlorinated isocyanurate. Commercial automatic dishwashing compositions contain chlorinated trisodium phosphate as the active chlorine agent. This is a crystalline complex or association of trisodium phosphate and sodium hypochlorite. Although stable in the highly alkaline detergent systems, its available chlorine is limited - of the order to 3 to 4% by weight of the chlorinated trisodium phosphate. As a consequence, large amounts, on the order of 50% are needed in order to provide adequate chlorine levels, typically about 1.5% in detergent compositions. This is decidedly disadvantageous since chlorinated trisodium phosphate contributes little or no detergent action and is thus essentially an inert active chlorine carrier. Chlorinated isocyanurates, on the other hand, contain high concentrations of available chlorine; about 63% in the case of sodium dichloroisocyanurate, a commercially available dry bleach. Manifestly, it would be highly desirable to utilize sodium dichloroisocyanurate as the source of active chlorine in automatic dishwashing compositions since the requisite active chlorine levels could be attained without introducing a large percentage of inert chlorine carrier such as characterizes the presently used chlorinated trisodium phosphate. Thus far, the advantage aforesaid has not been realized because of the instability of chlorinated isocyanurates under the highly alkaline conditions which prevail in the manufacture and use of agglomerated dishwashing composition.

In accordance with the present invention, the surprising discovery was made that a specific chlorinated isocyanurate — to wit sodium dichloroisocyanurate dihydrate (having 56% available chlorine) is unexpectedly stable when incorporated as the active chlorine source in agglomerated automatic dishwashing compositions. Such compositions which exhibit remarkably low chlorine loss contain by weight on a 100% basis the following essential components:

| | |
|---|---|
| Sodium dichloroisocyanurate dihydrate | 0.5–10% preferably 1.0–2.5% |
| A polyphosphate having an $Na_2O$ or $K_2O$ to $P_2O_5$ ratio of about 1:1 to 2:1 | 25–60' (anhydrous basis) preferably 28–50% |
| Sodium carbonate | 0–60' (anhydrous basis) preferably 0–30% |
| A sodium silicate having a $SiO_2$ to $Na_2O$ ratio of from about 2.40 to about 3.22 | 10–15% (total silicate solids) |
| Low-foaming chlorine-compatible nonionic surfactant | 1–10% |
| Water | 5–20% (preferably 10–20%) |

In preparing the agglomerated dishwashing compositions herein, the dry components are blended together while being moistened with water or a suitable aqueous solution. Where the surfactant is a liquid, it is added in the same manner. The liquid components can be applied by spraying, simple dropwise addition or any of the known procedures for wetting solids. The amount of water is at least adequate to wet the anhydrous components so as to promote agglomeration but not sufficient to destroy the discrete particle characteristic of the mixture.

Although the sodium silicate can be used in dry powder form, it is conveniently introduced with the water as an aqueous sodium silicate solution. The water content of liquid sodium silicates herein is generally from about 40 to about 75% by weight. In any event, the amounts of water added either alone or as silicate solution is such that the overall water content by weight of the finished product ranges from about 5 to about 20% while the silicate expressed as total sodium silicate solid varies from about 10 to 15%. The minimal amount of water is that required to wet the condensed phosphate whereby the various constituents are agglomerated. The maximum quantity of water added is limited to that which completely hydrates the anhydrous polyphosphates and anhydrous sodium carbonate; exceeding this quantity would destroy the discrete particle characteristic of the mixture.

The nonionic surfactant components result in a composition high in food soil defoaming power, i.e., a composition which has little or no tendency to foam by itself or in the presence of a foam-producing food soil. The nonionic surfactant employed must have a combination of three properties: (1) it must be a low-foaming material; (2) it must be capable of defoaming food soils such as milk; and (3) it must be compatible with chlorinated isocyanurates, that is, it must not decompose these chlorinated compounds markedly in the formulation.

Nonionic surfactants which meet these requirements include the lower alkyl ethers of polyoxyethylated octylphenols such as those sold under the Triton CF tradename, for example, "Triton CF-54" which is the butyl ether of polyoxyethylated octylphenol; an alkylether of polyoxyethylated alkanol such as "Triton DF-12"; polyoxyalkylene glycols having a plurality of alternating hydrophobic and hydrophilic polyoxyalkylene chains, the hydrophilic chains consisting of linked oxyethylene radicals and the hydrophobic chains consisting of linked oxypropylene radicals, said product having three hydrophobic chains linked by two hydrophilic chains, the central hydrophobic chain constituting 30 to 34% by weight of the product, the terminal hydrophobic chains together constituting 31 to 39% by weight of the product, the linking hydrophilic chains together constituting 31 to 35% by weight of the product, the intrinsic viscosity of the product being from about 0.06 to 0.09 and the molecular weight of the product being from about 3000 to 5000, all as described in U.S. Pat. No. 3,048,548; the alkyl polyoxyalkylene ether alcohols based on straight chain biodegradable hydrophobic segments, for example "Tretolite H-0307-S"; and the water-soluble benzyl ether of octylphenol condensed with ethylene oxide. Other nonionic surfactants are suitable for use in the herein dishwashing preparations and it is not intended to exclude any surfactant possessing the above properties.

Sodium dichloroisocyanurate dihydrate is a known chemical entity which is documented extensively in the patent literature. Its description and preparation is disclosed in U.S. Pat. No. 3,035,056.

The polyphosphate component functions as a water softener and a detergent builder. Polyphosphates of commerce, having an $Na_2O$ or $K_2O$ to $P_2O_5$ mol ratio of about 1:1 to 2:1 can be used. Typical polyphosphates of this kind are the preferred sodium tripolyphosphate, sodium hexametaphosphate and sodium pyrophosphate as well as the corresponding potassium salts of these phosphates. The particle size of the polyphosphate is not considered critical and any finely divided commercially available product can be employed.

While the above constitutes the essential ingredients of the composition it is to be understood that additional ingredients such as fillers, e.g., sodium chloride, sodium sulfate, etc., coloring agents and perfumes may also be added without departing from the basic formulation. All essential components listed herein are by weight based on the total composition and add up to 100%.

The following examples are merely illustrative, the invention being limited only by the scope of the appended claims; all parts are by weight.

METHOD OF PREPARATION

The sodium tripolyphosphate (anhydrous), sodium carbonate (anhydrous) and sodium dichloroisocyanurate (dihydrate) ingredients in each composition were thoroughly dry blended in a Hobart Model N-50 laboratory mixer. To the resulting homogeneous powder (mainly 20–100 mesh particle size) was added the surfactant, at room temperature, followed by the dropwise introduction of aqueous sodium silicate. Continuous agitation was maintained during addition of the liquid components; no heating or cooling was required. The so-obtained free-flowing granular mixture was placed in permeable containers (250 ml Erlenmeyer flasks covered with caps of polyethylene coated paper) and stored at 100°F and 80% relative humidity for two weeks. Before and after this storage period, the products were analyzed for available chlorine, and the percentage of the initial available chlorine which remained after storage was calculated.

Using the generalized procedure aforesaid, three exemplary formulations of the invention were prepared and identified as comositions 1*a*, 2*a* and 3*a* in Table I. Identical comparative formulations were prepared except that sodium dichloroisocyanurate (dihydrate) was replaced by commercial sodium dichloroisocyanurate (anhydrous) and identified as compositions 1*b*, 2*b* and 3*b* of Table I.

The percent of initial available chlorine remaining after storage for the two sets of compositions is set forth in Table II. As is readily apparent from the comparison data of this table, the stability of the dishwashing compositions containing sodium dichloroisocyanurate dihydrate (*a* series) is markedly greater than that of those compositions containing the commercial anhydrous sodium dichloroisocyanurate (*b* series). Clearly, the data of Table II demonstrate the feasibility of using sodium dichloroisocyanurate in dihydrate form as a means of producing stable, agglomerated dishwashing compositions containing a chlorinated isocyanurate as the active chlorine agent — a hitherto unrealized objective.

TABLE I

| Component | COMPOSITIONS, % BY WEIGHT 1a | 1b | 2a | 2b | 3a | 3b |
|---|---|---|---|---|---|---|
| Sodium dichloroisocyanurate (dihydrate) (% by weight to give 1.5% available chlorine) | 2.7 | — | 2.7 | — | 2.7 | — |
| Sodium dichloroisocyanurate (anhydrous) (% by weight to give 1.5% available chlorine) | — | 2.4 | — | 2.4 | — | 2.4 |
| Sodium tripolyphosphate (anhydrous) | 50.0 | 50.0 | 50.0 | 50.0 | 50.0 | 50.0 |
| Sodium carbonate (anhydrous) | 18.3 | 18.6 | 17.3 | 17.6 | 14.3 | 14.6 |
| Pluronic RA-40 nonionic surfactant[1] | 5.0 | 5.0 | 5.0 | 5.0 | 5.0 | 5.0 |
| RU Brand[2] liquid sodium silicate $SiO_2$:$Na_2O$ 2.40 (13.8% $Na_2O$, 33.2% $SiO_2$, 53.0% $H_2O$) | 24.0[3] | 24.0[3] | — | — | — | — |
| K Brand[2] liquid sodium silicate $SiO_2$:$Na_2O$ 2.90 (11.0% $Na_2O$, 31.9% $SiO_2$, 57.1% $H_2O$) | — | — | 25.0[4] | 25.0[4] | — | — |
| N Brand[2] liquid sodium silicate $SiO_2$:$Na_2O$ 3.22 | — | — | — | — | 28.0[5] | 28.0[5] |

TABLE I-continued

| Component | COMPOSITIONS, % BY WEIGHT 1a | 1b | 2a | 2b | 3a | 3b |
|---|---|---|---|---|---|---|
| (8.9% $Na_2O$, 28.7% $SiO_2$, 62.4% $H_2O$) | | | | | | |

[1]Low-foaming, chlorine-compatible 100% active liquid nonionic surfactant, modified oxyethylated straight-chain alcohol; product of BASF Wyandotte.
[2]Philadelphia Quartz Company, proprietary products.
[3]Yielding in the final formulation; 11.3% sodium silicate (8% $SiO_2$) and 12.7% water.
[4]Yielding 10.7% sodium silicate (8% $SiO_2$) and 14.3% water.
[5]Yielding 10.5% sodium silicate (8% $SiO_2$) and 17.5% water.

TABLE II

| Composition | STABILITY DATA % Initial Available Chlorine Remaining After 2 Weeks Storage* |
|---|---|
| 1a | 53 |
| 1b | 33 |
| 2a | 58 |
| 2b | 48 |
| 3a | 47 |
| 3b | 32 |

*Storage conditions: Samples were placed in moisture-permeable container such that the entire sample is exposed to a 100°F/80% relative humidity environment.

The *b* compositions contain commercial sodium dichloroisocyanurate as the dry bleach component. The *a* compositions contain sodium dichloroisocyanurate dihydrate as the dry bleach component.

What is claimed is:

1. An agglomerated dishwashing detergent composition containing by weight as its essential ingredients:

| | |
|---|---|
| Sodium dichloroisocyanurate dihydrate | 0.5–10% |
| A polyphosphate having an $Na_2O$ or $K_2O$ to $P_2O_5$ ratio of about 1:1 to 2:1 | 25–60% (anhydrous basis) |
| Sodium carbonate | 0–60% (anhydrous basis) |
| A sodium silicate having a $SiO_2$ to $Na_2O$ ratio of from about 2.40 to about 3.22 | 10–15% (total silicate solids) |
| Low-foaming chlorine-compatible nonionic surfactant | 1–10% |
| Water | 5–20%. |

2. The composition of claim 1 wherein the polyphosphate is anhydrous sodium tripolyphosphate.

3. A process of preparing an agglomerated dishwashing detergent composition containing by weight as its essential ingredients:

| | |
|---|---|
| Sodium dichloroisocyanurate dihydrate | 0.5–10% |
| A polyphosphate having an $Na_2O$ or $K_2O$ to $P_2O_5$ ratio of about 1:1 to 2:1 | 25–60% (anhydrous basis) |
| Sodium carbonate | 0–60% (anhydrous basis) |
| A sodium silicate having a $SiO_2$ to $Na_2O$ ratio of from about 2.40 to about 3.22 | 10–15% (total silicate solids) |
| Low-foaming chlorine-compatible nonionic surfactant | 1–10% |
| Water | 5–20% |

comprising forming a homogeneous dry mixture of the water-free components and adding to the dry mixture with agitation sufficient water to induce agglomeration and insufficient to destroy the discrete particle characteristic of the mixture, the total amount of water in the finally agglomerated composition being in the numerical range aforesaid.

4. The process according to claim 3 wherein the water is added with the sodium silicate as an aqueous solution thereof.

5. The process according to claim 4 wherein the surfactant is a liquid which is added to the dry mixture either along with or separately from the aqueous silicate.

* * * * *